US008292398B2

(12) United States Patent
Mizes et al.

(10) Patent No.: US 8,292,398 B2
(45) Date of Patent: Oct. 23, 2012

(54) METHOD AND SYSTEM FOR PRINTHEAD ALIGNMENT TO COMPENSATE FOR DIMENSIONAL CHANGES IN A MEDIA WEB IN AN INKJET PRINTER

(75) Inventors: Howard A. Mizes, Pittsford, NY (US); R. Enrique Viturro, Rochester, NY (US); David A. Mantell, Rochester, NY (US); Jeffrey J. Folkins, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 368 days.

(21) Appl. No.: 12/780,645

(22) Filed: May 14, 2010

(65) Prior Publication Data

US 2011/0279513 A1 Nov. 17, 2011

(51) Int. Cl.
*B41J 29/393* (2006.01)

(52) U.S. Cl. ..... 347/19; 347/14; 347/42

(58) Field of Classification Search ..... 347/5, 9, 347/14, 19, 42
See application file for complete search history.

(56) References Cited

U.S. PATENT DOCUMENTS

| | | | | |
|---|---|---|---|---|
| 4,940,996 | A | 7/1990 | Paton et al. | |
| 5,093,674 | A | 3/1992 | Storlie | |
| 5,500,667 | A | 3/1996 | Schwiebert et al. | |
| 5,633,668 | A | 5/1997 | Schwiebert et al. | |
| 6,017,113 | A | 1/2000 | Nicoloff, Jr. et al. | |
| 6,412,907 | B1 | 7/2002 | Castelli et al. | |
| 6,536,894 | B1 | 3/2003 | Rasmussen et al. | |
| 6,587,652 | B2 | 7/2003 | Metzler | |
| 6,788,432 | B1 | 9/2004 | Garcia et al. | |
| 6,799,830 | B1 | 10/2004 | Brookfield et al. | |
| 7,167,770 | B1 | 1/2007 | Akira | |
| 7,216,948 | B2 * | 5/2007 | Matsuzaki et al. | 347/14 |
| 7,309,118 | B2 * | 12/2007 | Mizes et al. | 347/19 |
| 7,691,280 | B2 | 4/2010 | Waldrop et al. | |
| 2003/0132979 | A1 | 7/2003 | Taylor | |
| 2003/0156148 | A1 | 8/2003 | King et al. | |
| 2008/0124158 | A1 | 5/2008 | Folkins | |

(Continued)

FOREIGN PATENT DOCUMENTS

EP 0340960 11/1989

(Continued)

OTHER PUBLICATIONS

United Kingdom Search Report corresponding to UK Application No. 1107830.0, United Kingdom Intellectual Property Office, Newport, South Wales, UK, Sep. 7, 2011 (3 pages).

(Continued)

*Primary Examiner* — Lam S Nguyen
(74) *Attorney, Agent, or Firm* — Maginot, Moore & Beck, LLP

(57) ABSTRACT

A method enables a controller to align printheads in a printer. The method includes identifying a first cross-process position for each printhead in a plurality of printheads in a printer with reference to image data of a test pattern printed by the plurality of printheads on a media substrate, identifying a second cross-process position for each printhead in the plurality of printheads, calculating a printhead cross-process position error between the identified first cross-process position and the identified second cross-process position for each printhead, comparing a maximum printhead cross-process position error to a predetermined threshold, and operating a plurality of actuators with reference to the calculated printhead cross-process position errors to reposition the printheads in the plurality of printheads in response to the maximum printhead cross-process position error being equal to or less than the predetermined threshold.

26 Claims, 7 Drawing Sheets

U.S. PATENT DOCUMENTS

| | | | |
|---|---|---|---|
| 2009/0141110 | A1 | 6/2009 | Gervasi et al. |
| 2009/0293750 | A1 | 12/2009 | Haenni et al. |
| 2010/0013882 | A1 | 1/2010 | Mizes et al. |
| 2011/0012958 | A1 | 1/2011 | Mantell et al. |

FOREIGN PATENT DOCUMENTS

| | | | |
|---|---|---|---|
| EP | 1 447 226 | A1 | 8/2004 |
| EP | 1 609 602 | A3 | 12/2005 |
| EP | 1 669 204 | A1 | 6/2006 |
| WO | 0156798 | | 8/2001 |

OTHER PUBLICATIONS

European Search Report corresponding to European Patent Application 10169752.2, European Patent Office, Rijswijk, Netherlands, Oct. 26, 2010 (6 pages).

Nguyen, Thinh H., Non-final Office Action for U.S. Appl. No. 12/504,857, mailed Aug. 31, 2011 (8 pages).

Lockman, David M., Response to Non-final Office Action for U.S. Appl. No. 12/504,857, submitted Nov. 30, 2011 (11 pages).

* cited by examiner

METHOD AND SYSTEM FOR PRINTHEAD ALIGNMENT TO COMPENSATE FOR DIMENSIONAL CHANGES IN A MEDIA WEB IN AN INKJET PRINTER

TECHNICAL FIELD

This disclosure relates generally to printhead alignment in an inkjet printer having one or more printheads, and, more particularly, to the positioning of printheads to compensate for detected dimensional changes in a media web as it passes through an inkjet printer.

BACKGROUND

Ink jet printers have printheads that operate a plurality of inkjets that eject liquid ink onto an image receiving member. The ink may be stored in reservoirs located within cartridges installed in the printer. Such ink may be aqueous, oil, solvent-based, or UV curable ink or an ink emulsion. Other inkjet printers receive ink in a solid form and then melt the solid ink to generate liquid ink for ejection onto the imaging member. In these solid ink printers, the solid ink may be in the form of pellets, ink sticks, granules or other shapes. The solid ink pellets or ink sticks are typically placed in an ink loader and delivered through a feed chute or channel to a melting device that melts the ink. The melted ink is then collected in a reservoir and supplied to one or more printheads through a conduit or the like. In other inkjet printers, ink may be supplied in a gel form. The gel is also heated to a predetermined temperature to alter the viscosity of the ink so the ink is suitable for ejection by a printhead.

A typical full width scan inkjet printer uses one or more printheads. Each printhead typically contains an array of individual nozzles for ejecting drops of ink across an open gap to an image receiving member to form an image. The image receiving member may be a continuous web of recording media, a series of media sheets, or the image receiving member may be a rotating surface, such as a print drum or endless belt. Images printed on a rotating surface are later transferred to recording media by mechanical force in a transfix nip formed by the rotating surface and a transfix roller. In an inkjet printhead, individual piezoelectric, thermal, or acoustic actuators generate mechanical forces that expel ink through an orifice from an ink filled conduit in response to an electrical voltage signal, sometimes called a firing signal. The amplitude, or voltage level, of the signals affects the amount of ink ejected in each drop. The firing signal is generated by a printhead controller in accordance with image data. An inkjet printer forms a printed image in accordance with the image data by printing a pattern of individual ink drops at particular locations on the image receiving member. The locations where the ink drops landed are sometimes called "ink drop locations," "ink drop positions," or "pixels." Thus, a printing operation can be viewed as the placement of ink drops on an image receiving member in accordance with image data.

In order for the printed images to correspond closely to the image data, both in terms of fidelity to the image objects and the colors represented by the image data, the printheads must be registered with reference to the imaging surface and with the other printheads in the printer. Registration of printheads is a process in which the printheads are operated to eject ink in a known pattern and then the printed image of the ejected ink is analyzed to determine the orientation of the printhead with reference to the imaging surface and with reference to the other printheads in the printer. Operating the printheads in a printer to eject ink in correspondence with image data presumes that the printheads are level with a width across the image receiving member and that all of the inkjet ejectors in the printhead are operational. The presumptions regarding the orientations of the printheads, however, cannot be assumed, but must be verified. Additionally, if the conditions for proper operation of the printheads cannot be verified, the analysis of the printed image should generate data that can be used either to adjust the printheads so they better conform to the presumed conditions for printing or to compensate for the deviations of the printheads from the presumed conditions.

Analysis of printed images is performed with reference to two directions. "Process direction" refers to the direction in which the image receiving member is moving as the imaging surface passes the printhead to receive the ejected ink and "cross-process direction" refers to the direction across the width of the image receiving member. In order to analyze a printed image, a test pattern needs to be generated so determinations can be made as to whether the inkjets operated to eject ink did, in fact, eject ink and whether the ejected ink landed where the ink would have landed if the printhead was oriented correctly with reference to the image receiving member and the other printheads in the printer. In some printing systems, an image of a printed image is generated by printing the printed image onto media or by transferring the printed image onto media, ejecting the media from the system, and then scanning the image with a flatbed scanner or other known offline imaging device. This method of generating a picture of the printed image suffers from the inability to analyze the printed image in situ and from the inaccuracies imposed by the external scanner. In some printers, a scanner is integrated into the printer and positioned at a location in the printer that enables an image of an ink image to be generated while the image is on media within the printer or while the ink image is on the rotating image member. These integrated scanners typically include one or more illumination sources and a plurality of optical detectors that receive radiation from the illumination source that has been reflected from the image receiving surface. The radiation from the illumination source is usually visible light, but the radiation may be at or beyond either end of the visible light spectrum. If light is reflected by a white imaging surface, the reflected light has a similar spectrum as the illuminating light. In some systems, ink on the imaging surface may absorb a portion of the incident light, which causes the reflected light to have a different spectrum. In addition, some inks may emit radiation in a different wavelength than the illuminating radiation, such as when an ink fluoresces in response to a stimulating radiation. Each optical sensor generates an electrical signal that corresponds to the intensity of the reflected light received by the detector. The electrical signals from the optical detectors may be converted to digital signals by analog/digital converters and provided as digital image data to an image processor.

The environment in which the image data are generated is not pristine. Several sources of noise exist in this scenario and should be addressed in the registration process. For one, alignment of the printheads can deviate from an expected position significantly, especially when different types of imaging surfaces are used or when printheads are replaced. Additionally, not all jets in a printhead remain operational without maintenance. Thus, a need exists to continue to register the heads before maintenance can recover the missing jets. Also, some jets are intermittent, meaning the jet may fire sometimes and not at others. Jets also may not eject ink perpendicularly with respect to the face of the printhead. These off-angle ink drops land at locations other than were they are expected to land. Some printheads are oriented at an angle with respect to the width of the image receiving member. This angle is sometimes known as printhead roll in the art. The image receiving member also contributes noise. Specifically, structure in the image receiving surface and/or colored contaminants in the image receiving surface may be identified as ink drops in the image data and lightly colored inks and weakly performing jets provide ink drops that contrast less starkly with the image receiving member than darkly colored inks or ink drops formed with an appropriate ink drop mass. Thus, improvements in printed images and the analysis of the image data corresponding to the printer images are useful for identifying printhead orientation deviations and printhead characteristics that affect the ejection of ink from a printhead. Moreover, image data analysis that enables correction of printhead issues or compensation for printhead issues is beneficial.

One factor affecting the registration of images printed by different groups of printheads is media shrinkage. Media shrinkage is caused as the media is subjected to relatively high temperatures as the media moves along the relatively long path through the printing system. In a web printing system, any high temperatures can drive moisture content from the web, which causes the web to shrink. If the physical dimensions of the web change after one group of printheads has formed an image in one color ink, but before another group of printheads has formed an image in another color of ink, then the registration of the two images is affected. The change may be sufficient to cause misregistration between ink patterns ejected by the different groups of printheads. The amount of shrinkage depends upon the heat to which the web is subjected, the speed of the web as it moves over heated components, the moisture content of the paper, the type of media material, and other factors.

Media shrinkage affects the accuracy of the image analysis that enables printhead position correction. If media shrinkage is not considered during the analysis, the compensation data generated during the analysis are insufficient to achieve proper registration between the printheads. Reducing the effect of web dimensional changes on the analysis of test pattern images and the generation of the correction data for printhead positioning is a goal in web printing systems.

SUMMARY

A method of operating a printer enables a controller to align printheads in the printer to compensate for dimensional changes in media as the media travels through the printer. The method includes identifying a first cross-process position for each printhead in a plurality of printheads in a printer, the first cross-process positions being identified with reference to image data of a test pattern printed by the plurality of printheads on a media substrate as the media substrate passes the plurality of printheads in a process direction, identifying a second cross-process position for each printhead in the plurality of printheads, calculating a printhead cross-process position error between the identified first cross-process position and the identified second cross-process position for each printhead, comparing a maximum printhead cross-process position error to a predetermined threshold, and operating a plurality of actuators with reference to the calculated printhead cross-process position errors to reposition the printheads in the plurality of printheads in response to the maximum printhead cross-process position error being equal to or less than the predetermined threshold.

A printer is configured to use the method to align printheads in the printer to compensate for dimensional changes that occur in media as the media passes through the printer. The printer includes a media transport that is configured to transport media through the printer in a process direction, a plurality of bars that extend across a portion of the media transport in a cross-process direction that is orthogonal to the process direction, each bar having a number of printheads mounted to the bar and spaced from one another in the cross-process direction, the printheads on adjacent bars being configured to print a contiguous line across media being transported through the printer in the process direction, a plurality of actuators, at least one actuator being operatively connected to each bar in the plurality of bars to translate the bar in the cross-process direction and at least one actuator for each bar that is operatively connected to one printhead mounted on the bar to translate the printhead in the cross-process direction, an imaging device mounted proximate to a portion of the media transport to generate image data corresponding to a cross-process portion of the media being transported through the printer in the process direction after the media has received ink ejected from the printheads mounted to the bars, and a controller operatively connected to the imaging device, the plurality of actuators, and the printheads, the controller being configured to operate the printheads to eject ink onto media in a test pattern arrangement as the media is being transported past the printheads on the bars, to receive image data generated by the imaging device, and to process the image data to identify a cross-process position error between a first cross-process position for each printhead and a second cross-process position for each printhead and to operate the plurality of actuators to modify alignment of the printheads mounted on the plurality of bars with one another in response to a maximum identified cross-process position error not exceeding a predetermined threshold.

BRIEF DESCRIPTION OF THE DRAWINGS

The foregoing aspects and other features of a printer that generates a test pattern that better identifies printhead orientations and characteristics and that analyzes the image data corresponding to the generated test pattern are explained in the following description, taken in connection with the accompanying drawings.

DETAILED DESCRIPTION

Figure 5:
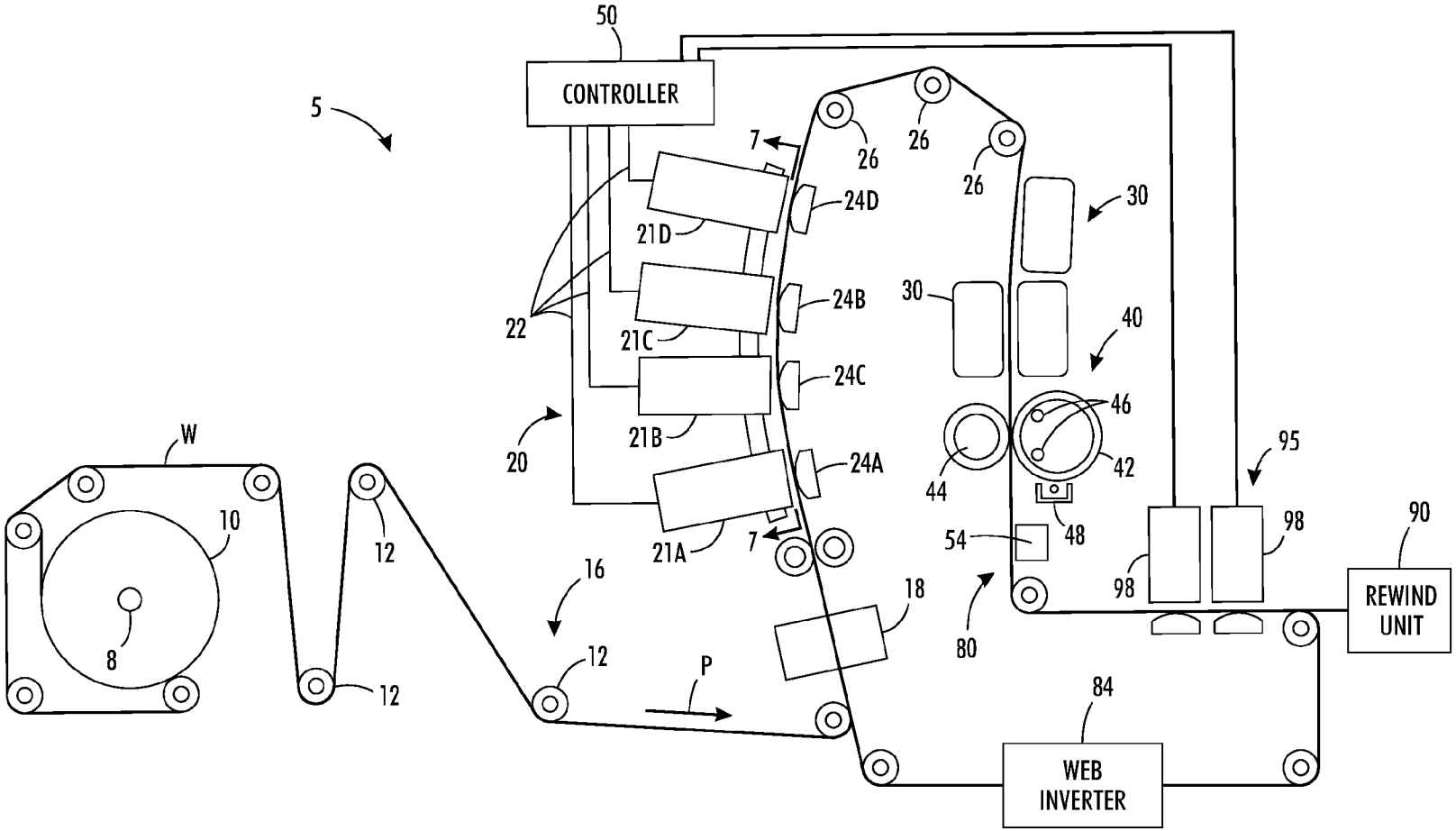
FIG. 5 is a schematic view of an improved inkjet imaging system that ejects ink onto a continuous web of media as the media moves past the printheads in the system.

Referring to FIG. 5, an inkjet imaging system 5 is shown. For the purposes of this disclosure, the imaging apparatus is in the form of an inkjet printer that employs one or more inkjet printheads and an associated solid ink supply. The controller, discussed in more detail below, may be configured to implement the processes discussed above to align printheads in the system and the printheads in the system 5 may be configured as described herein. The test pattern and methods described herein are applicable to any of a variety of other imaging apparatus that use inkjets to eject one or more colorants to a medium or media.

The imaging apparatus 5 includes a print engine to process the image data before generating the control signals for the inkjet ejectors. The colorant may be ink, or any suitable substance that includes one or more dyes or pigments and that may be applied to the selected media. The colorant may be black, or any other desired color, and a given imaging apparatus may be capable of applying a plurality of distinct colorants to the media. The media may include any of a variety of substrates, including plain paper, coated paper, glossy paper, or transparencies, among others, and the media may be available in sheets, rolls, or another physical formats.

Direct-to-sheet, continuous-media, phase-change inkjet imaging system 5 includes a media supply and handling system configured to supply a long (i.e., substantially continuous) web of media W of "substrate" (paper, plastic, or other printable material) from a media source, such as spool of media 10 mounted on a web roller 8. For simplex printing, the printer is comprised of feed roller 8, media conditioner 16, printing station 20, printed web conditioner 80, coating station 95, and rewind unit 90. For duplex operations, the web inverter 84 is used to flip the web over to present a second side of the media to the printing station 20, printed web conditioner 80, and coating station 95 before being taken up by the rewind unit 90. In the simplex operation, the media source 10 has a width that substantially covers the width of the rollers over which the media travels through the printer. In duplex operation, the media source is approximately one-half of the roller widths as the web travels over one-half of the rollers in the printing station 20, printed web conditioner 80, and coating station 95 before being flipped by the inverter 84 and laterally displaced by a distance that enables the web to travel over the other half of the rollers opposite the printing station 20, printed web conditioner 80, and coating station 95 for the printing, conditioning, and coating, if necessary, of the reverse side of the web. The rewind unit 90 is configured to wind the web onto a roller for removal from the printer and subsequent processing.

The media may be unwound from the source 10 as needed and propelled by a variety of motors, not shown, rotating one or more rollers. The media conditioner includes rollers 12 and a pre-heater 18. The rollers 12 control the tension of the unwinding media as the media moves along a path through the printer. In alternative embodiments, the media may be transported along the path in cut sheet form in which case the media supply and handling system may include any suitable device or structure that enables the transport of cut media sheets along a desired path through the imaging device. The pre-heater 18 brings the web to an initial predetermined temperature that is selected for desired image characteristics corresponding to the type of media being printed as well as the type, colors, and number of inks being used. The preheater 18 may use contact, radiant, conductive, or convective heat to bring the media to a target preheat temperature, which in one practical embodiment, is in a range of about 30° C. to about 70° C.

The media is transported through a printing station 20 that includes a series of color units 21A, 21B, 21C, and 21D, each color unit effectively extending across the width of the media and being able to place ink directly (i.e., without use of an intermediate or offset member) onto the moving media. The arrangement of printheads in the print zone of system 5 is discussed in more detail with reference to FIG. 7. As is generally familiar, each of the printheads may eject a single color of ink, one for each of the colors typically used in color printing, namely, cyan, magenta, yellow, and black (CMYK). The controller 50 of the printer receives velocity data from encoders mounted proximately to rollers positioned on either side of the portion of the path opposite the four color units to calculate the linear velocity and position of the web as moves past the printheads. The controller 50 uses these data to generate timing signals for actuating the inkjet ejectors in the printheads to enable the four colors to be ejected with a reliable degree of accuracy for registration of the differently colored patterns to form four primary-color images on the media. The inkjet ejectors actuated by the firing signals corresponds to image data processed by the controller 50. The image data may be transmitted to the printer, generated by a scanner (not shown) that is a component of the printer, or otherwise generated and delivered to the printer. In various possible embodiments, a color unit for each primary color may include one or more printheads; multiple printheads in a color unit may be formed into a single row or multiple row array; printheads of a multiple row array may be staggered; a printhead may print more than one color; or the printheads or portions of a color unit may be mounted movably in a direction transverse to the process direction P, such as for spot-color applications and the like.

Each of color units 21A-21D includes at least one actuator configured to adjust the printheads in each of the printhead modules in the cross-process direction across the media web. In a typical embodiment, each motor is an electromechanical device such as a stepper motor or the like. One embodiment illustrating a configuration of print bars, printheads, and actuators is discussed below with reference to FIG. 4. In a practical embodiment, a print bar actuator is connected to a print bar containing two or more printheads. The print bar actuator is configured to reposition the print bar by sliding the print bar along the cross-process axis of the media web. Printhead actuators may also be connected to individual printheads within each of color units 21A-21D. These printhead actuators are configured to reposition an individual printhead by sliding the printhead along the cross-process axis of the media web. In this specific embodiment the printhead actuators are devices that physically move the printheads in the cross process direction. In alternative embodiments, an actuator system may be used that does not physically move the printheads, but redirects the image data to different ejectors in each head to change head position. Such an actuator system, however, can only reposition the printhead in increments of at least the cross process direction ejector to ejector spacing. As used in this document, "reposition printhead" includes the redirection of image data to different ejectors in a printhead to change the position of images printed by a printhead in ejector increments in the cross-process direction as well as physical movement of printheads.

The printer may use "phase-change ink," by which is meant that the ink is substantially solid at room temperature and substantially liquid when heated to a phase change ink melting temperature for jetting onto the imaging receiving surface. The phase change ink melting temperature may be any temperature that is capable of melting solid phase change ink into liquid or molten form. In one embodiment, the phase change ink melting temperature is approximately 70° C. to 140° C. In alternative embodiments, the ink utilized in the imaging device may comprise UV curable gel ink. Gel ink may also be heated before being ejected by the inkjet ejectors of the printhead. As used herein, liquid ink refers to melted solid ink, heated gel ink, or other known forms of ink, such as aqueous inks, ink emulsions, ink suspensions, ink solutions, or the like.

Associated with each color unit is a backing member 24A-24D, typically in the form of a bar or roll, which is arranged substantially opposite the color unit on the back side of the media. Each backing member is used to position the media at a predetermined distance from the printheads opposite the backing member. Each backing member may be configured to emit thermal energy to heat the media to a predetermined temperature which, in one practical embodiment, is in a range of about 40° C. to about 60° C. The various backer members may be controlled individually or collectively. The pre-heater 18, the printheads, backing members 24 (if heated), as well as the surrounding air combine to maintain the media along the portion of the path opposite the printing station 20 in a predetermined temperature range of about 40° C. to 70° C.

As the partially-imaged media moves to receive inks of various colors from the printheads of the color units, the temperature of the media is maintained within a given range. Ink is ejected from the printheads at a temperature typically significantly higher than the receiving media temperature. Consequently, the ink heats the media. Therefore other temperature regulating devices may be employed to maintain the media temperature within a predetermined range. For example, the air temperature and air flow rate behind and in front of the media may also impact the media temperature. Accordingly, air blowers or fans may be utilized to facilitate control of the media temperature. Thus, the media temperature is kept substantially uniform for the jetting of all inks from the printheads of the color units. Temperature sensors (not shown) may be positioned along this portion of the media path to enable regulation of the media temperature. These temperature data may also be used by systems for measuring or inferring (from the image data, for example) how much ink of a given primary color from a printhead is being applied to the media at a given time.

Following the printing zone 20 along the media path are one or more "mid-heaters" 30. A mid-heater 30 may use contact, radiant, conductive, and/or convective heat to control a temperature of the media. The mid-heater 30 brings the ink placed on the media to a temperature suitable for desired properties when the ink on the media is sent through the spreader 40. In one embodiment, a useful range for a target temperature for the mid-heater is about 35° C. to about 80° C. The mid-heater 30 has the effect of equalizing the ink and substrate temperatures to within about 15° C. of each other. Lower ink temperature gives less line spread while higher ink temperature causes show-through (visibility of the image from the other side of the print). The mid-heater 30 adjusts substrate and ink temperatures to −10° C. to 20° C. above the temperature of the spreader.

Following the mid-heaters 30, a fixing assembly 40 is configured to apply heat and/or pressure to the media to fix the images to the media. The fixing assembly may include any suitable device or apparatus for fixing images to the media including heated or unheated pressure rollers, radiant heaters, heat lamps, and the like. In the embodiment of the FIG. 5, the fixing assembly includes a "spreader" 40, that applies a predetermined pressure, and in some implementations, heat, to the media. The function of the spreader 40 is to take what are essentially droplets, strings of droplets, or lines of ink on web W and smear them out by pressure and, in some systems, heat, so that spaces between adjacent drops are filled and image solids become uniform. In addition to spreading the ink, the spreader 40 may also improve image permanence by increasing ink layer cohesion and/or increasing the ink-web adhesion. The spreader 40 includes rollers, such as image-side roller 42 and pressure roller 44, to apply heat and pressure to the media. Either roll can include heat elements, such as heating elements 46, to bring the web W to a temperature in a range from about 35° C. to about 80° C. In alternative embodiments, the fixing assembly may be configured to spread the ink using non-contact heating (without pressure) of the media after the print zone. Such a non-contact fixing assembly may use any suitable type of heater to heat the media to a desired temperature, such as a radiant heater, UV heating lamps, and the like.

In one practical embodiment, the roller temperature in spreader 40 is maintained at a temperature to an optimum temperature that depends on the properties of the ink such as 55° C.; generally, a lower roller temperature gives less line spread while a higher temperature causes imperfections in the gloss. Roller temperatures that are too high may cause ink to offset to the roll. In one practical embodiment, the nip pressure is set in a range of about 500 to about 2000 psi. Lower nip pressure gives less line spread while higher pressure may reduce pressure roller life.

The spreader 40 may also include a cleaning/oiling station 48 associated with image-side roller 42. The station 48 cleans and/or applies a layer of some release agent or other material to the roller surface. The release agent material may be an amino silicone oil having viscosity of about 10-200 centipoises. Only small amounts of oil are required and the oil carried by the media is only about 1-10 mg per A4 size page. In one possible embodiment, the mid-heater 30 and spreader 40 may be combined into a single unit, with their respective functions occurring relative to the same portion of media simultaneously. In another embodiment the media is maintained at a high temperature as it is printed to enable spreading of the ink.

The coating station 95 applies a clear ink to the printed media. This clear ink helps protect the printed media from smearing or other environmental degradation following removal from the printer. The overlay of clear ink acts as a sacrificial layer of ink that may be smeared and/or offset during handling without affecting the appearance of the image underneath. The coating station 95 may apply the clear ink with either a roller or a printhead 98 ejecting the clear ink in a pattern. Clear ink for the purposes of this disclosure is functionally defined as a substantially clear overcoat ink or varnish that has minimal impact on the final printed color, regardless of whether or not the ink is devoid of all colorant. In one embodiment, the clear ink utilized for the coating ink comprises a phase change ink formulation without colorant. Alternatively, the clear ink coating may be formed using a reduced set of typical solid ink components or a single solid ink component, such as polyethylene wax, or polywax. As used herein, polywax refers to a family of relatively low molecular weight straight chain poly ethylene or poly methylene waxes. Similar to the colored phase change inks, clear phase change ink is substantially solid at room temperature and substantially liquid or melted when initially jetted onto the media. The clear phase change ink may be heated to about 100° C. to 140° C. to melt the solid ink for jetting onto the media.

Following passage through the spreader 40 the printed media may be wound onto a roller for removal from the system (simplex printing) or directed to the web inverter 84 for inversion and displacement to another section of the rollers for a second pass by the printheads, mid-heaters, spreader, and coating station. The duplex printed material may then be wound onto a roller for removal from the system by rewind unit 90. Alternatively, the media may be directed to other processing stations that perform tasks such as cutting, binding, collating, and/or stapling the media or the like.

Operation and control of the various subsystems, components and functions of the device 5 are performed with the aid of the controller 50. The controller 50 may be implemented with general or specialized programmable processors that execute programmed instructions. The instructions and data required to perform the programmed functions may be stored in memory associated with the processors or controllers. The processors, their memories, and interface circuitry configure the controllers and/or print engine to perform the functions, such as the processes for identifying printhead positions and compensation factors described above. These components may be provided on a printed circuit card or provided as a circuit in an application specific integrated circuit (ASIC). Each of the circuits may be implemented with a separate processor or multiple circuits may be implemented on the same processor. Alternatively, the circuits may be implemented with discrete components or circuits provided in VLSI circuits. Also, the circuits described herein may be implemented with a combination of processors, ASICs, discrete components, or VLSI circuits. Controller 50 may be operatively coupled to the print bar and printhead actuators of color units 21A-21D in order to adjust the position of the print bars and printheads along the cross-process axis of the media web.

The imaging system 5 may also include an optical imaging system 54 that is configured in a manner similar to that described above for the imaging of the printed web. The optical imaging system is configured to detect, for example, the presence, intensity, and/or location of ink drops jetted onto the receiving member by the inkjets of the printhead assembly. The light source for the imaging system may be a single light emitting diode (LED) that is coupled to a light pipe that conveys light generated by the LED to one or more openings in the light pipe that direct light towards the image substrate. In one embodiment, three LEDs, one that generates green light, one that generates red light, and one that generates blue light are selectively activated so only one light shines at a time to direct light through the light pipe and be directed towards the image substrate. In another embodiment, the light source is a plurality of LEDs arranged in a linear array. The LEDs in this embodiment direct light towards the image substrate. The light source in this embodiment may include three linear arrays, one for each of the colors red, green, and blue. Alternatively, all of the LEDS may be arranged in a single linear array in a repeating sequence of the three colors. The LEDs of the light source may be coupled to the controller 50 or some other control circuitry to activate the LEDs for image illumination.

The reflected light is measured by the light detector in optical sensor 54. The light sensor, in one embodiment, is a linear array of photosensitive devices, such as charge coupled devices (CCDs). The photosensitive devices generate an electrical signal corresponding to the intensity or amount of light received by the photosensitive devices. The linear array that extends substantially across the width of the image receiving member. Alternatively, a shorter linear array may be configured to translate across the image substrate. For example, the linear array may be mounted to a movable carriage that translates across image receiving member. Other devices for moving the light sensor may also be used.

A schematic view of a prior art print zone 900 that may be aligned using the processes described above is depicted in FIG. 7. The print zone 900 includes four color units 912, 916, 920, and 924 arranged along a process direction 904. Each color unit ejects ink of a color that is different than the other color units. In one embodiment, color unit 912 ejects black ink, color unit 916 ejects yellow ink, color unit 920 ejects cyan ink, and color unit 924 ejects magenta ink. Process direction 904 is the direction that an image receiving member moves as the member travels under the color units from color unit 924 to color unit 912. Each color unit includes two print bar arrays, each of which includes two print bars that carry multiple printheads. For example, the print bar array 936 of magenta color unit 924 includes two print bars 940 and 944. Each print bar carries a plurality of printheads, as exemplified by printhead 948. Print bar 940 has three printheads, while print bar 944 has four printheads, but alternative print bars may employ a greater or lesser number of printheads. The printheads on the print bars within a print array, such as the printheads on the print bars 940 and 944, are staggered to provide printing across the image receiving member in the cross process direction at a first resolution. The printheads on the print bars of the print bar array 936 within color unit 924 are interlaced with reference to the printheads in the print bar array 938 to enable printing in the colored ink across the image receiving member in the cross process direction at a second resolution. The print bars and print bar arrays of each color unit are arranged in this manner. One print bar array in each color unit is aligned with one of the print bar arrays in each of the other color units. The other print bar arrays in the color units are similarly aligned with one another. Thus, the aligned print bar arrays enable drop-on-drop printing of different primary colors to produce secondary colors. The interlaced printheads also enable side-by-side ink drops of different colors to extend the color gamut and hues available with the printer.

Figure 4:
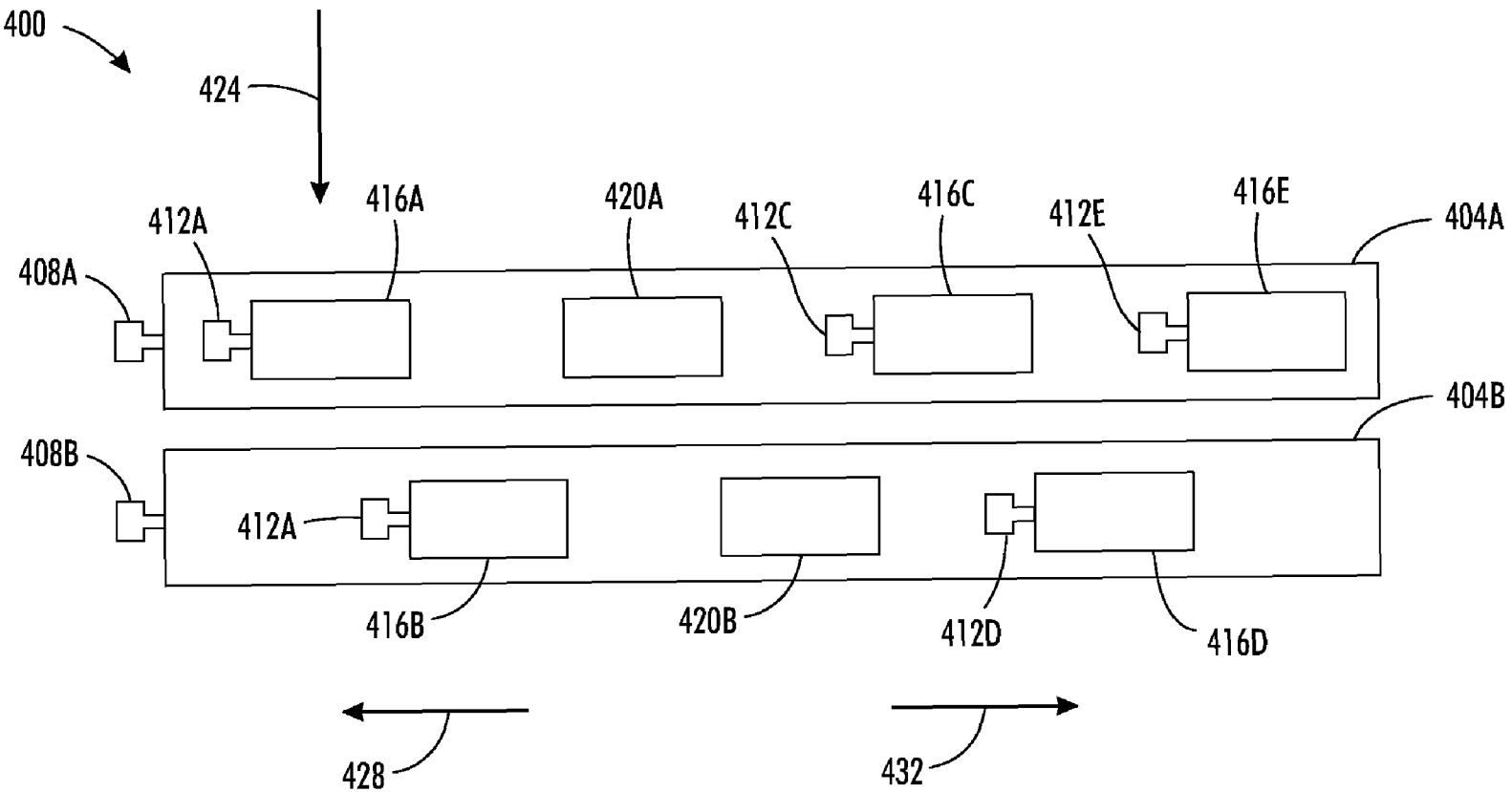
FIG. 4 is a schematic view of a print bar unit.

FIG. 4 depicts a configuration for a pair of print bars that may be used in a color unit of the system 5. The print bars 404A and 404B are operatively connected to the print bar motors 408A and 408B, respectively, and a plurality of printheads 416A-E and 420A, 420B are mounted to the print bars. Printheads 416A-E are operatively connected to electrical motors 412A-E, respectively, while printheads 420A and 420B are not connected to electrical motors, but are fixedly mounted to the print bars 404A and 404B, respectively. Each print bar motor moves the print bar operatively connected to the motor in either of the cross-process directions 428 or 432. Printheads 416A-416E and 420A-420B are arranged in a staggered array to allow inkjet ejectors in the printheads to print a continuous line in the cross-process direction across a media web. As used in this document, a "print bar array" refers to the printheads mounted to two adjacent print bars in the process direction that eject the same color of ink. Movement of a print bar causes all of the printheads mounted on the print bar to move an equal distance. Each of printhead motors 412A-412E moves an individual printhead in either of the cross-process directions 428 or 432. Motors 408A-408B and 412A-412D are electromechanical stepper motors capable of rotating a shaft, for example shaft 414, in a series of one or more discrete steps. Each step rotates the shaft a predetermined angular distance and the motors may rotate in either a clockwise or counter-clockwise direction. The rotating shafts turn drive screws that translate print bars 404A-404B and printheads 416A-416E along the cross-process directions 428 and 432.

While the print bars of FIG. 4 are depicted with a plurality of printheads mounted to each print bar, one or more of the print bars may have a single printhead mounted to the bar. Such a printhead would be long enough in the cross-process direction to enable ink to be ejected onto the media across the full width of the document printing area of the media. In such a print bar unit, an actuator may be operatively connected to the print bar or to the printhead. A process similar to the one discussed below may then be used to position such a wide printhead with respect to multiple printheads mounted to a single print bar or to other equally wide printheads mounted to other print bars. The actuators in this embodiment enable the inkjet ejectors of one printhead to be interlaced or aligned with the inkjet ejectors of another printhead in the process direction.

Figure 2:
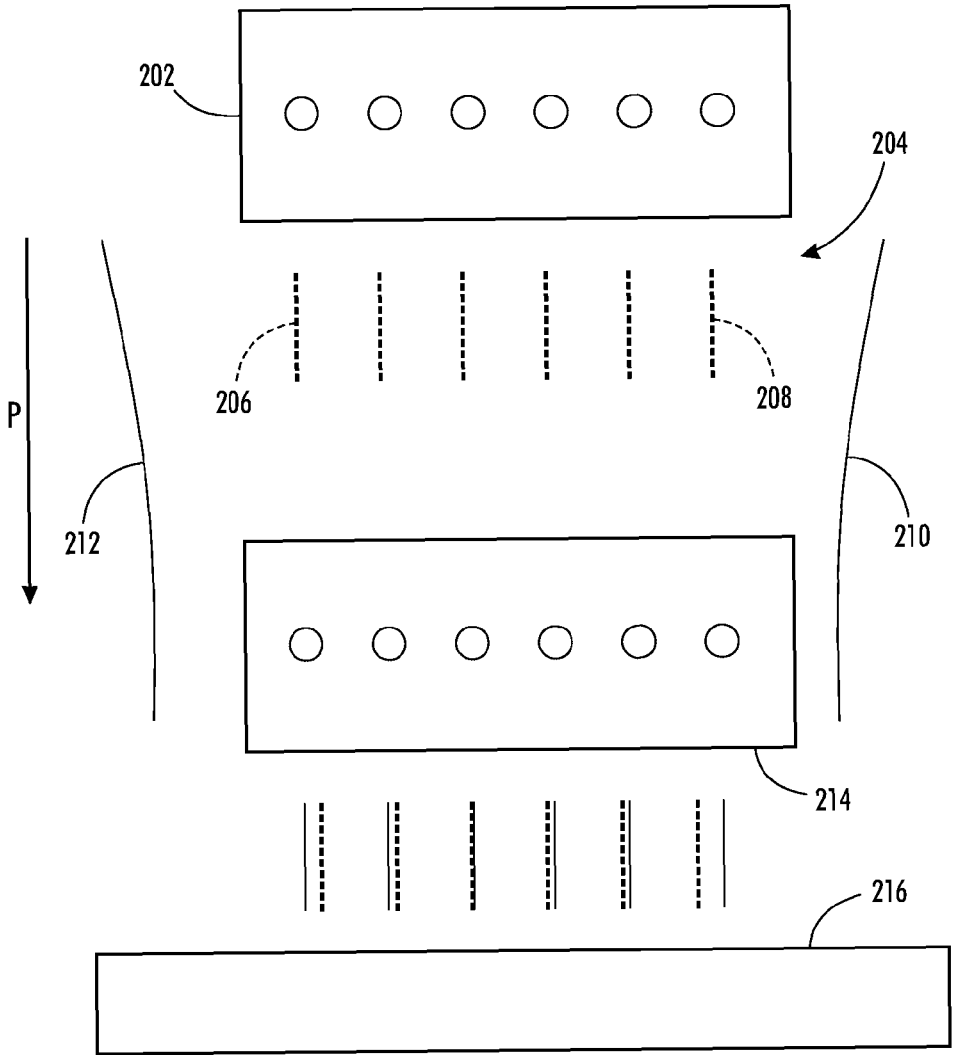
FIG. 2 is a depiction of a test pattern printed on a medium that is subject to shrinkage during the printing process.

The length of the print zone in a system configured as the one described with reference to FIG. 5 may lead to media shrinkage during the printing process. An example of media shrinkage and the effect of such shrinkage on a test pattern are shown in FIG. 2. In the figure, printhead 202 prints a set of dashes 204 using six ejectors in the printhead. As used in this document, a "dash" refers to a predetermined number of ink drops ejected by an inkjet ejector onto an image receiving substrate. A group of dashes printed by different ejectors form a test pattern. Image data corresponding to this test pattern may then be generated and analyzed to identify positions of the inkjet ejectors and printheads. The dashed lines 206 and 208 are produced by the first and last ejectors of the six ejectors used. Lines 210 and 212 represent the edges of the media as it progresses through the print zone. As the media travels in the process direction P through the print zone, the dashed lines 206 and 208 move because the media shrinks. When the dashed lines 204 reach the printhead 214, the solid lines printed by six ejectors in the printhead 214 are displaced from the dashed lines even though the six ejectors in printhead 202 are aligned with the six ejectors in printhead 214. The image data corresponding to the test pattern on the media generated by the optical sensing array may be analyzed to measure the amount of shrinkage. Specifically, averaging the detected shrinkage from patterns printed by multiple printheads on the same print bar enables errors introduced by the optical sensors and other random sources of error to be identified and the degree of media shrinkage estimated. As used in this document, "mean average" and "average" refer to any mathematical technique for calculating, identifying, or substantially approximating a statistical average.

In order to correct for media shrinkage, the relative differences in shrinkage between different print bar arrays in the print zone are determined. For example, in a printing system where the print bar arrays print, in order of the process direction, magenta, cyan, yellow, and black, the media web shrinks the most from the time the web is at the magenta printheads until the web reaches the black printheads. The degree of relative shrinkage occurring between consecutive print bar arrays, such as between the magenta and cyan array, is smaller. Since the web portion printed by the first print bar array experiences the greatest degree of relative shrinkage as the media web travels through the print zone, the first print bar array may be used to serve as a reference point for measuring relative degrees of media shrinkage. In a printing system where the magenta print bar array prints to the media web first, the relative degrees of shrinkage may be described as $\Delta S_{MC}$, $\Delta S_{MY}$, and $\Delta S_{MK}$ where the "c", "y", and "k" subscripts represent the cyan, yellow, and black print bar arrays, respectively. As an example, if the averaged absolute shrinkage for a magenta print bar array is 45 μm/head, and the averaged absolute shrinkage for the black print bar array is 20 μm/head, then $\Delta S_{MK}$ is 25 μm/head.

Figure 1:
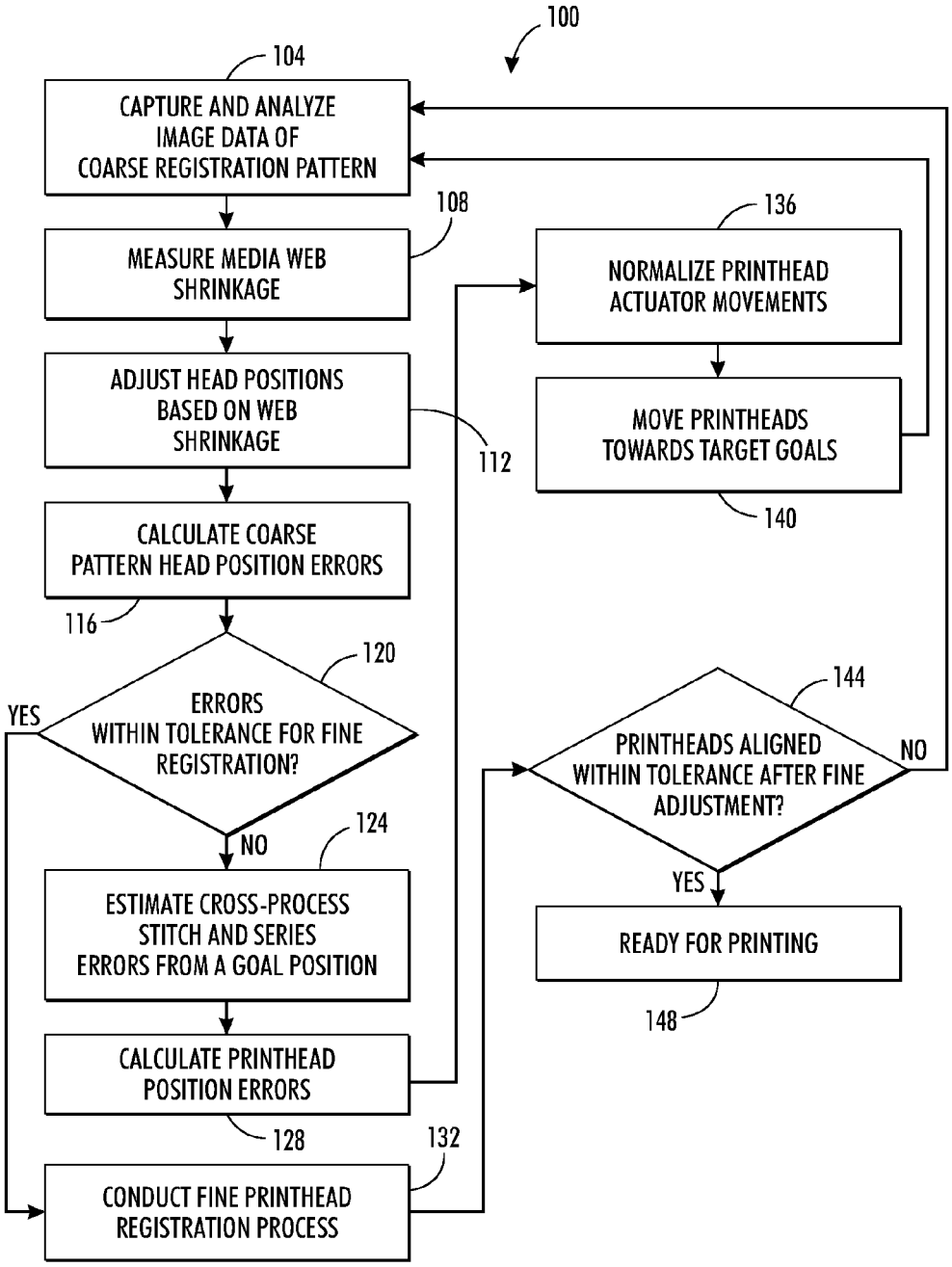
FIG. 1 is a block diagram of a process for analyzing image data of a test pattern generated by a printer.

Referring to FIG. 1, a process 100 for analyzing printed test patterns and adjusting printheads in response to registration errors caused by the shrinkage of a media web while passing through a print zone is depicted. Process 100 begins by printing a coarse registration test pattern on the media web and analyzing image data corresponding to the test pattern printed on the media (block 104). The coarse registration test pattern analysis identifies initial positions for printheads that may be significantly different than the target positions for the printheads. A suitable coarse registration test pattern and method for identifying the initial positions for the printheads to correct for detected registration errors are disclosed in U.S. Utility application Ser. No. 12/754,730, which is entitled "Test Pattern Effective For Coarse Registration Of Inkjet Printheads And Method Of Analysis Of Image Data Corresponding To The Test Pattern In An Inkjet Printer", which is commonly owned by the owner of this document and was filed on Apr. 6, 2010, the disclosure of which is incorporated into this document by reference in its entirety.

Figure 6:
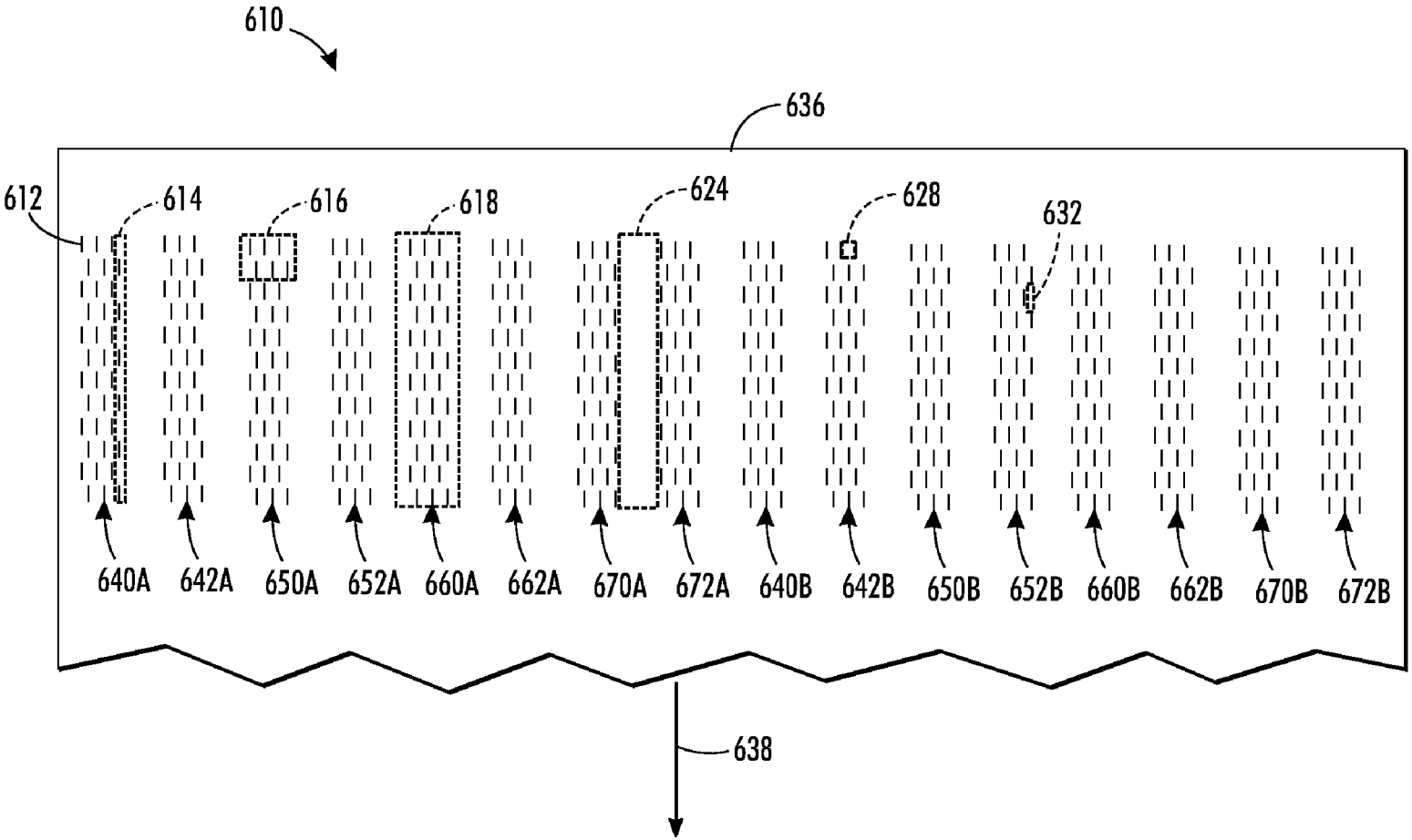
FIG. 6 is an illustration of a printhead calibration test pattern used to evaluate coarse registration in the printer of FIG. 5.

An example of a registration test pattern suitable for use with process 100 is depicted in FIG. 6. Test pattern 610 includes a plurality of arrangements 618 of dashes 612 suitable for printing on an image receiving member 636, which is depicted in the figure as a sheet of paper, although the image receiving member may be a print web, offset imaging member, or the like. The image receiving member 636 moves in the process direction past a plurality of printheads that eject ink onto the image receiving member to form the test pattern 610. The test pattern arrangements 618 are separated from one another by a predetermined horizontal distance 624. Each test pattern arrangement 618 includes a plurality of clusters 616 of dashes 612. Each cluster 616 is printed by a group of inkjet ejectors in a single printhead. A printhead forming a cluster 616 of dashes 612 is operated repeatedly to print a plurality of clusters 616 to form an arrangement 618 of dashes 612. In each column, such as column 614, within an arrangement 618 of dashes 612, a predetermined distance 632 separates each dash 612 in one cluster 616 from a next dash in another cluster 616 of the arrangement 618 in the process direction. In the embodiment shown in FIG. 6, each cluster 616 has six dashes produced by six different ejectors arranged in a single printhead. Each dash 612 is formed with a predetermined number of droplets ejected by an inkjet ejector. Each cluster 616 has two staggered rows of three dashes 612 each, with a predetermined distance 628 separating the dashes 612 in a cluster 616 in the cross-process direction.

The test pattern arrangements 618 depicted in FIG. 6 are further grouped into pairs, with each pair of test pattern arrangements being generated by a different printhead ejecting the same color of ink. Multiple test pattern arrangements 618 may also be used in multi-colored printing systems, such as cyan, magenta, yellow, black (CMYK) systems. In printing systems that interlace two or more printheads that eject the same color of ink to increase the cross-process resolution and that align two or more printheads of different colors to enable color printing, adjacent test pattern arrangements 618 may be generated by printheads ejecting the same color of ink that are shifted by a distance of one-half an inkjet ejector. This shift is sometimes known as interlacing. According to the embodiment of FIG. 6, adjacent test pattern arrangements 640A and 642A are generated by two cyan ink ejecting printheads that are interlaced to increase the cross-process resolution of the cyan printing. Likewise, adjacent test pattern arrangements 640B and 642B are generated by different nozzles on the same two cyan printheads. Test pattern arrangements 640A and 640B are printed by one cyan ink ejecting printhead, while the test pattern arrangements 642A and 642B are printed by a second cyan ink ejecting printhead that is interlaced with the first cyan ink ejecting printhead. In FIG. 6, test pattern groups 650A and 650B are from a first magenta printhead while test pattern groups 652A and 652B are from a second, magenta printhead that is interlaced with the first magenta printhead. The same sequence applies for the printhead producing test pattern groups 660A and 660B and the printhead producing test pattern 662A and 662B for the color yellow. Black ink is produced by the printheads that generate test patterns 670A and 670B and 672A and 672B. The series of test pattern arrangements depicted in FIG. 6 may be repeated across the width of an image receiving member for multiple printheads.

After coarse registration image processing is successfully completed, errors in printhead alignment may still exist, but further identification of printhead positions cannot be easily obtained with the coarse registration process. A separate fine-registration process may then be used to generate a fine registration test pattern on the media and image data corresponding to the fine registration test pattern on the media are processed to identify further the positions of the printheads. A suitable fine-registration test pattern and registration process is disclosed in U.S. Utility application Ser. No. 12/754,735, which is entitled "Test Pattern Effective For Fine Registration Of Inkjet Printheads And Method Of Analysis Of Image Data Corresponding To The Test Pattern In An Inkjet Printer", which is commonly owned by the owner of this document and was filed on Apr. 6, 2010, the disclosure of which is incorporated into this document by reference in its entirety. Both the coarse and fine registration processes adjust the printheads to correct for series errors and stitch errors. Series errors occur when printheads that are targeted to have their centers aligned in the process direction are displaced from one another in the cross-process direction. These errors cause ink droplets from printheads of different colors that are supposed to have aligned centers in the process position to not form secondary colors properly. These errors arise because secondary colors are produced by placing droplets of two or more of the primary CMYK colors in the same location or in close proximity to one another. Stitch errors occur when ink droplets from adjacent printheads of the same color are not placed in the correct position in the cross-process direction. These errors may result in ink streaking where two adjacent printheads print to the same location twice, or in gaps where two adjacent printheads leave a visible space between printed ink droplets.

Identification of the printhead centers using the coarse registration process is affected by shrinkage of the media as the media passes by the printheads for the printing of the test pattern. Specifically, the width of a portion of the test pattern printed by printheads that are positioned earlier in the process direction shrinks before another portion of the test pattern is printed by printheads positioned later in the process direction. Thus, the later printing printheads eject a portion of the test pattern that is wider than the shrunken portion and the positioning of the marks in the test pattern are different than the intended positions. These errors are confounded with other known sources of error in the measurement of the head width that include errors, distortions in the optics of the sensor array, alignment of the detecting elements in the sensing array, and errors occurring when individual ejectors in a printhead misfire.

Process 100 compensates for the errors mentioned above to reduce their impact on the coarse registration process (block 108). Each printhead in the print zone is manufactured with a known width and a predetermined spacing between ejectors in the printhead. Errors introduced by shrinkage of the media web result in a narrowing of the width of the coarse registration test pattern. Using the coarse registration test pattern from a single printhead, the cross-process distance between the mark corresponding to the first ejector in a printhead to the final ejector in the printhead can be measured to obtain a width of the printhead with reference to the image data of the coarse registration pattern. The expected distance is calculated with reference to the equation:

$$(N-1)s$$

where N is the number of ejectors in the test pattern, and s is the predetermined distance expected between each ejector. As used in this document, the words "calculate" and "identify" include the operation of a circuit comprised of hardware, software, or a combination of hardware and software that reaches a result based on one or more measurements of physical relationships with accuracy or precision suitable for a practical application.

Process 100 uses the measured absolute shrinkage parameters to adjust the goal position of printheads identified in the course registration process (block 112). This adjustment is made by selecting one of the series columns of printheads in the print zone as a reference column, and then determining the relative goal displacement of the remaining printhead columns from the reference column. For example, in FIG. 7 a reference column formed by printheads in different arrays could include printheads M22, M42, C22, C42, Y22, Y42, K22, and K42. All printheads in the reference column are considered to have an offset of zero, and the calculated positions of printheads in the remaining columns are adjusted according to following equation:

$$(i-j)\Delta S_{XM}$$

Figure 7:
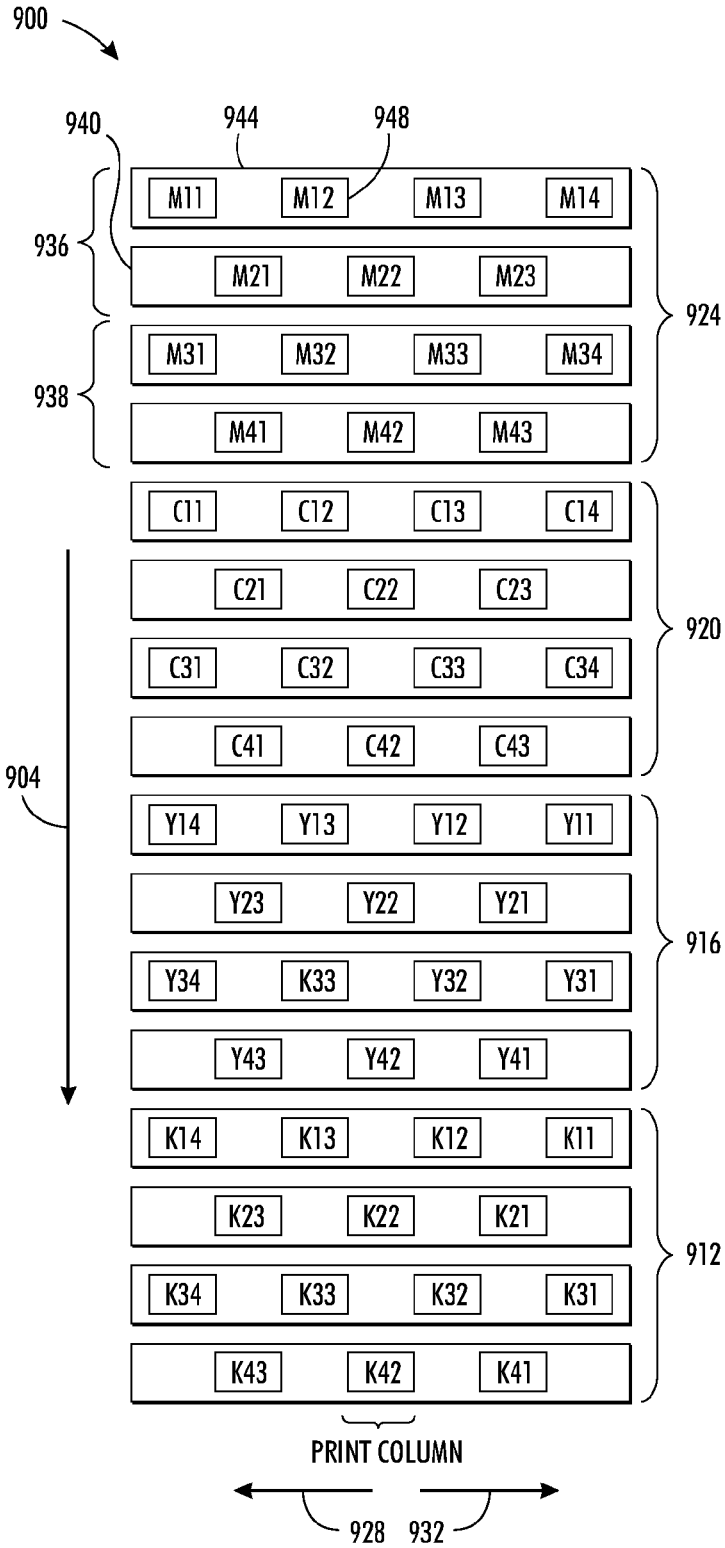
FIG. 7 PRIOR ART
FIG. 7 is a schematic view of a prior art printhead configuration viewed along lines 7-7 in FIG. 5.

In this equation, i represents the column number of the reference column, and j is the column number of the column being adjusted. X in the equation is one of M, C, Y, or K for the magenta, cyan, yellow, or black print bar arrays, respectively. Consider, for example, a six ejector print head with an expected spacing of 40 microns between ejectors. The expected width of the printhead would be 200 microns. The goal position of the first jet of the adjacent printhead in the next print column should be 240 microns from the first jet of the center printhead. However, suppose the printhead width is measured to be 230 microns. The goal position should therefore also be adjusted to 230 microns. Even though the spacing in the print zone may be 240 microns, the goal position refers to the spacing at the time the printed image reaches the sensor. The difference may result in a positive or negative number, which indicates the direction along the cross-process axis in which the adjustment should be made. In FIG. 7, the reference print column has an i index of 3, while there are seven (7) total printheads having j indexes numbering zero (0) through six (6). In FIG. 7, the first print bar array for the magenta unit would have a column number to printhead relationship as depicted in Table 1, although alternative methods for numbering columns are also possible. The index numbers include printheads from both print bars in the print bar array.

TABLE 1

| Printhead Label | Index Number | Difference from Reference Index |
|---|---|---|
| M11 | 0 | 3 |
| M21 | 1 | 2 |
| M12 | 2 | 1 |
| M22 | 3 | 0 |
| M13 | 4 | −1 |
| M23 | 5 | −2 |
| M14 | 6 | −3 |

Process 100 continues by calculating the positional errors of the printheads from the printhead positions identified by the analysis of the image data for the coarse registration test pattern and the intended positions for the printheads. These positional errors include the corrections due to media shrinkage discussed above (block 116). If the calculated errors are within the tolerances that may be handled by the fine registration process (block 120), then process 100 may proceed to conduct the fine registration process (block 132). The tolerances measured before the fine registration process commences include determining if the absolute value of cross-process error for any of the printheads exceeds a predetermined threshold distance. However, if the tolerances are not equal to or less than the threshold that enables the fine-registration process to commence, then process 100 estimates the cross-process stitch and series errors in relation to the intended positions for the printheads (block 124). The intended position for calculating series error is the average position of all the printheads in a column of printheads, and the series alignment errors are the differences between each printhead and this average position for the column. The intended position for calculating a stitch error is determined by identifying the differences in calculated errors between adjacent printheads in the same print bar array that were previously calculated in the process of FIG. 1 at block 116. For example, if printhead K11 has a cross-process error of 30 μm in direction 928, and adjacent printhead K21 has a cross-process error of 20 μm in direction 928, then a 10 μm overlap exists between the two printheads. Conversely, if printhead K11 has a cross-process error of 20 μm in direction 928, and printhead K21 has a cross-process error of 30 μm in direction 928, then a 10 μm gap exists between the two printheads.

Figure 3A:
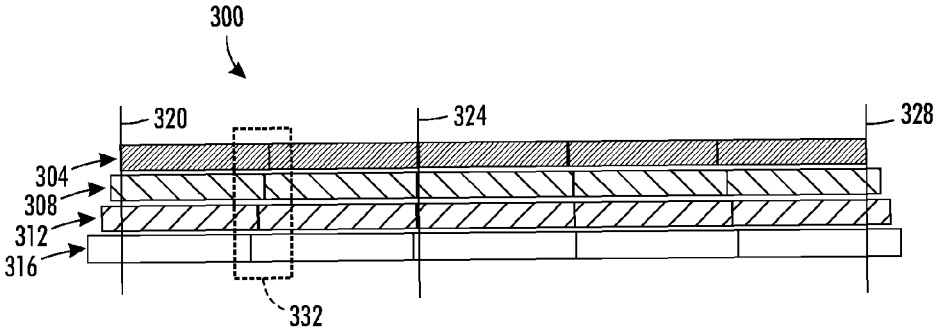
FIG. 3A is an illustration of lines produced by printheads having series and stitch alignment printed on a medium that is subject to shrinkage during the printing process.
Figure 3B:
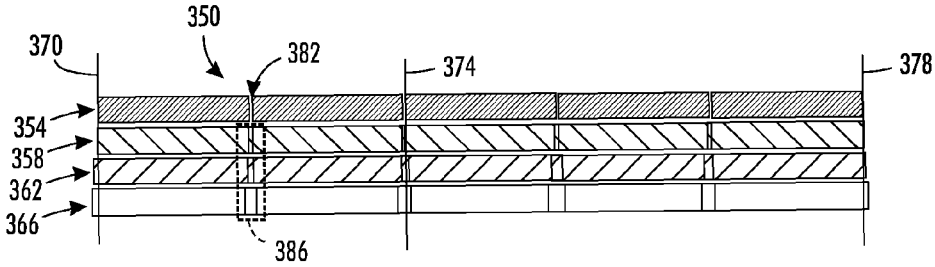
FIG. 3B is an illustration of lines produced by printheads having averaged center series alignment printed on a medium that is subject to shrinkage during the printing process.

After calculating the series and stitch errors of the printheads, adjustments may be made to the printhead positions in order to reduce the series and stitch errors. However, when taking the effects of media shrinkage into account, tradeoffs between series and stitch errors as depicted in FIG. 3A and FIG. 3B need to be considered. This tradeoff arises from the observation that stitch error and alignment error cannot both be made zero in the presence of media shrinkage without introducing color errors. That is, even if the centers of printheads in a column are aligned and adjacent printheads on adjacent print bar units of the same color are aligned so no gaps or overlap exists between the printhead ends, then shrinkage causes colors to register improperly, particularly at the edges of the media. To illustrate, FIG. 3A depicts a magenta line 304, a cyan line 308, a yellow line 312, and a black line 316. FIG. 3A depicts the lines printed by the printheads of adjacent print bar units ejected the same color of ink (see discussion of FIG. 7) that have been aligned so the stitch error between adjacent printheads on the adjacent print bar rows is zero and the center of the printheads in each column are aligned in the process direction. The stitching alignment within each printed line 304-316 has no perceivable error as shown by the interfaces between adjacent printheads seen in area 332. As with the previous examples, the colored lines are presented in the process direction that prints the magenta line 304 first and the black line 316 last. The shrinkage of the media web during the printing process, however, results in black line 316 being longer than the magenta line 304. This displacement of the magenta line caused by media shrinkage produces color errors as best seen at process-direction lines 320, 324, and 328. Near the center of the media web at line 324, the degree of error is relatively small, with the magenta line 304 experiencing the most shrinkage, and the black line 316 experiencing the least shrinkage. The errors introduced by media shrinkage are more significant at either edge of the media web because the outer edges of the magenta line do not reach the edges of the black line. The series errors seen at lines 320 and 328 are of a much larger magnitude. This misalignment arises from the relative differences in shrinkage of the media between the printing of the magenta line 304 and the printing of the black line 316 and not because the printhead centers are misaligned. The increased errors seen at lines 320 and 328 may lead to a noticeable discoloration along the edges of images and text. Thus, media shrinkage may produce an inferior printing result even when the printheads are in stitch alignment.

FIG. 3B depicts an improved printing result 350 where the effects of media shrinkage on series alignment are mitigated by intentionally allowing for a small stitch alignment error. That is, the controller implementing the printhead alignment process operates actuators for adjacent print bars and/or adjacent printheads to either separate adjacent printheads on adjacent print bars or overlap adjacent printheads on adjacent print bars by a distance corresponding to the measured media shrinkage to enable adjacent ends of the adjacent printheads to eject ink that has a gap between the ejected ink on the media or to overlap adjacent printheads on adjacent print bars by a predetermined distance to enable adjacent ends of the adjacent print bars to print ink that overlaps on the media. FIG. 3B depicts a magenta line 354, a cyan line 358, a yellow line 362, and a black line 366 as would be printed if no media shrinkage occurred. Thus, in the presence of media shrinkage, the gaps in the magenta line 354 are mitigated and the area where the magenta line fails to register with the black line is reduced. Specifically, the printheads in each column producing the lines in FIG. 3B are aligned with the centers of each printhead in series alignment after media shrinkage is taken into account. This type of series alignment produces small stitch alignment errors. As seen at gap 378, the magenta printheads, subject to the greatest amount of shrinkage, are aligned with gaps between them to increase the overall width of magenta line 354. As the media web shrinks, the gaps in the magenta line also shrink, reducing the impact of the stitch error. The remaining ink lines 358-366 are all aligned to have varying degrees of overlap to reduce the overall length of these lines, as seen by the overlap regions in area 386. The degree of overlap in each of lines 358-366 is determined by the relative differences in media shrinkage compared to magenta line 354. Thus, the degree of overlap in cyan line 358 is small, and the degree of overlap in black line 366 is larger. While there is still a small series error seen at lines 370, 374, and 378, the magnitude of the series error is smaller than that of FIG. 3A, particularly at the edges 370 and 378. The errors seen in FIG. 3B have a lower impact on the final image quality of images printed on the media web than the errors of FIG. 3A. Additionally, a printer with printheads aligned as seen in FIG. 3B may take additional steps to mitigate the effects of the stitching errors, such as selectively firing ejectors in only one of the overlapping printheads if an image calls for ink droplets in the cross-process areas where a stitching overlap exists. Thus, the adjustments made to the printhead positions placing the center of each printhead in series alignment after compensating for media shrinkage produces improved printed output.

Referring again to FIG. 1, process 100 calculates adjustments for positioning the printheads in the print zone to produce the alignment disclosed in FIG. 3B (block 128). One method of alignment that achieves the result of FIG. 3B, is to align the centers of printheads in each column of printheads with each other, after correcting for the effect that shrinkage has on the center of each printhead. Since each column has multiple printheads, the relative positions of the printheads are considered in determining the adjustments to be made. In making the adjustment three reference points are defined: the reference column, the reference print bar array, and a reference stitch value. The reference column is the same reference column discussed above with reference to block 112, and this column serves as the relative zero-position from which all alignment movements are made. For the reference print bar array, the goal is to set the stitch errors equal to the reference stitch value. Typically, the reference print bar array is a print bar array midway through the print zone and the reference stitch value is zero, but in general the reference print bar array may be any print bar array and the reference stitch value can be any positive or negative value. Since the alignment process intentionally sets a goal of having stitch errors in the reference print bar array, the calculation of relative head motion should also includes the desired degree of stitch error as seen in following equations:

$$\Delta X(P_n) = \left(\sum_{c=ref}^{n} \Delta x(P_c, P_{c+1})\right) - (n - ref)\Delta x_t$$

and $$\Delta X(P_n) = \left(\sum_{c=n}^{ref} \Delta x(P_c, P_{c+1})\right) - (ref - n)\Delta x_t$$

The first equation shows the error correction for printhead $P_n$ in the reference print bar array where n is the index number of the printhead, ref is the index number of the reference column, and $\Delta x(P_c,P_{c+1})$ is the measured stitch error between adjacent printheads starting from the reference column and going to the $P_n$. The $(n-ref)\Delta x_t$ term represents the intended stitching error needed to set the reference stitch in the reference print bar array. The equation applies to situations where the target printhead $P_n$ has a column number greater than or equal to the reference column number. The second equation finds the same sum of printhead distances as the first equation, but the second equation applies to target printheads with index numbers less than the reference column index number. The calculations of the two equations are carried out for each printhead in the reference print bar array. For printheads in print bar arrays that are not the reference print bar array, an additional term is evaluated to enable each print column to be aligned in series. The additional terms $\Delta x_c(P_n)$ move each printhead that is not in the reference print bar array so the printhead aligns in the cross process direction with a printhead in the same print column in the reference bar array. Specifically, for printheads not in the reference print bar array, the printhead is moved by:

$$\Delta X(P_n) = \left(\sum_{c=ref}^{n} \Delta x(P_c, P_{c+1})\right) - (n - ref)\Delta x_t - \Delta x_c(P_n)$$

and $$\Delta X(P_n) = \left(\sum_{c=n}^{ref} \Delta x(P_c, P_{c+1})\right) - (ref - n)\Delta x_t - \Delta x_c(P_n)$$

A print zone in a multi-color printer includes multiple print bar units such as print bar unit 400. In the example of FIG. 7, a total of eight print bar units are depicted with two print bar units for each of cyan, magenta, yellow, and black inks. In the example of FIG. 7, a total of eight print bar units are shown in color stations 912, 916, 920, and 924 with a total of fifty-six (56) printheads. Using the configuration of FIG. 4, there are a total of fifty-six (56) actuators that may be adjusted in cross-process directions 928 and 932. Since each of the print bars may be adjusted independently, an improper alignment may result when each of the printheads have proper stitch and series alignment relative to the other printheads, but where all of the print bar units are misaligned along the cross-process axis in either of directions 928 or 932. If the misalignment of all the print heads along either of directions 928 or 932 is too large, the motors 408A and 408B exceed their maximum range of motion.

Referring again to FIG. 1, process 100 maintains proper absolute cross-process alignment of all the print bar units by calculating normalized or correlated printhead movements to realign the printheads and print bars (block 136). One correlation method sums the net cross-process movements for all of the printheads in the system to zero. The sum of the head motion for all of the printheads calculated using the equations described above is calculated and divided by the number of printheads. The resulting quantity is subtracted from all of the position errors previously identified for the printheads in the printer. Another possible technique to correlate the printhead movements is to select a single printhead in the system of printheads and use this selected printhead as a fixed reference. The selected printhead need not be the reference printhead that is in both the reference print bar array and the reference column of printheads. In one embodiment, the selected printhead for correlation purposes remains the same to reduce the likelihood that the printheads migrate beyond the boundaries of the print zone. The motion of the selected printhead is subtracted from all of the other printheads, including the selected printhead, resulting in zero motion for the selected printhead and motions for the other printheads correlated to the selected printhead. Those skilled in the art can determine modifications of these techniques or similar techniques that give a constraint on the motion of all of the printheads in the directions 928 and 932. Once the correlated printhead positions are calculated, the print bar and printhead actuators adjust the printhead positions in the calculated directions and distances (block 140).

After the adjustments of process step 140, process 100 begins again by printing and generating image data for a new coarse registration test pattern (block 104). Process 100 may repeat multiple times in a feedback loop, successively adjusting the print bars units and printheads to within the tolerances needed for the fine registration process. Once the calculated errors are determined to be within the tolerance of the fine registration process (block 120), the fine registration process further adjusts the printhead positions (block 132), and if the fine registration process aligns the printheads to within an operating tolerance (block 144), the printer is ready to print images on the media web (block 148). Process 100 may be repeated periodically to return the printheads to alignment as needed during printing operations.

It will be appreciated that variants of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A method for analyzing image data of a test pattern generated by a printer comprising:

identifying a first cross-process position for each printhead in a plurality of printheads in a printer, the first cross-process positions being identified with reference to image data of a test pattern printed by the plurality of printheads on a media substrate as the media substrate passes the plurality of printheads in a process direction;

identifying a second cross-process position for each printhead in the plurality of printheads;

calculating a printhead cross-process position error between the identified first cross-process position and the identified second cross-process position for each printhead;

comparing a maximum printhead cross-process position error to a predetermined threshold; and operating a plurality of actuators with reference to the calculated printhead cross-process position errors to reposition the printheads in the plurality of printheads in response to the maximum printhead cross-process position error being equal to or less than the predetermined threshold.

2. The method of claim 1 further comprising:

adjusting either the identified first cross-process position for each printhead or the identified second cross-process position by a dimensional change in the media substrate that occurs after a first printhead in the plurality of printheads ejects ink onto the media substrate.

3. The method of claim 1, the identification of the second cross-process position for each printhead further comprising:

identifying the second cross-process position for each printhead with reference to a width for each printhead and a predetermined offset distance between printheads on two print bars on which the plurality of printheads are positioned within a print bar array.

4. The method of claim 1 wherein the test pattern is a plurality of arrangements of dashes ejected onto the media substrate, each arrangement of dashes having a predetermined number of rows and a predetermined number of columns, each dash in a row of dashes within an arrangement of dashes being separated by a first predetermined distance that corresponds to a distance in a cross-process direction between each inkjet ejector that ejected ink for a dash in a row of dashes and each dash in a column of dashes in the arrangement of dashes being separated by a second predetermined distance, each dash in a column of an arrangement of dashes being ejected by a single inkjet ejector in a printhead of the inkjet printer; and a plurality of unprinted areas interspersed between the plurality of arrangements of dashes.

5. The method of claim 1 further comprising:

identifying a stitch error between each pair of adjacent printheads in a print bar array; and identifying a series error for each printhead in a group of printheads that are arranged in a column in the process direction, stitch errors and series errors being identified in response to the maximum printhead position error being greater than the predetermined threshold.

6. The method of claim 5, the series error identification for each printhead in a group of printheads further comprising:

identifying an average position in the cross-process direction for the printheads arranged in a column; and calculating a difference between each first cross-process position for each printhead arranged in the column of printheads and the identified average position for the printheads in the column of printheads to identify a series error for each printhead arranged in the column of printheads.

7. The method of claim 5, the stitch error identification further comprising:

identifying differences between the calculated printhead cross-process position errors for adjacent printheads in a print bar array to identify stitch errors for adjacent printheads in the print bar array.

8. The method of claim 5 further comprising:

selecting a third cross-process position for each printhead in the plurality of printheads, the third cross-process position being selected to compensate for a dimensional change in the media; and identifying a second cross-process position error for each printhead that corresponds to a difference between the first cross-process position for a printhead and the identified third position for the printhead.

9. The method of claim 8, the second cross-process error identification further comprising:

selecting a column of printheads as a reference column of printheads;

selecting a print bar array as a reference print bar array;

selecting a printhead in the reference print bar array and the reference column of printheads as a reference printhead;

identifying a stitch error for each pair of adjacent printheads in the reference print bar array, each stitch error being identified with respect to the reference printhead;

identifying the second cross-process position error for each printhead in the reference print bar array with reference to the first cross-process position, the identified stitch error, and the identified third position; and identifying the second cross-process position error for each printhead not in the reference print bar array with reference to the first cross-process position for the printhead, the identified stitch error for the printhead in the reference print bar array that is also in a column of printheads for the printhead, and the identified third position for the printhead.

10. The method of claim 9 further comprising:

correlating all of the second cross-process position errors to a single second cross-process position error.

11. The method of claim 10, the correlation of the second cross-process position error further comprising:

identifying an average of all of the second cross-process position errors; and modifying each second cross-process position error by subtracting the average from each second cross-process position error.

12. The method of claim 10, the correlation of the second cross-process position error further comprising:

selecting one printhead from the plurality of printheads; and modifying each second cross-process position error by subtracting the second cross-process position error from each second cross-process position error for each printhead in the plurality of printheads.

13. The method of claim 9 wherein each actuator in the plurality of actuators is operated with reference to one of the identified second cross-process position errors.

14. A printer comprising:

a media transport that is configured to transport media through the printer in a process direction;

a plurality of bars that extend across a portion of the media transport in a cross-process direction that is orthogonal to the process direction, each bar having a number of printheads mounted to the bar and spaced from one another in the cross-process direction, the printheads on adjacent bars being configured to print a contiguous line across media being transported through the printer in the process direction;

a plurality of actuators, at least one actuator being operatively connected to each bar in the plurality of bars to translate the bar in the cross-process direction and at least one actuator for each bar that is operatively connected to one printhead mounted on the bar to translate the printhead in the cross-process direction;

an imaging device mounted proximate to a portion of the media transport to generate image data corresponding to a cross-process portion of the media being transported through the printer in the process direction after the media has received ink ejected from the printheads mounted to the bars; and a controller operatively connected to the imaging device, the plurality of actuators, and the printheads, the controller being configured to operate the printheads to eject ink onto media in a test pattern arrangement as the media is being transported past the printheads on the bars, to receive image data generated by the imaging device, and to process the image data to identify a cross-process position error between a first cross-process position for each printhead and a second cross-process position for each printhead and to operate the plurality of actuators to modify alignment of the printheads mounted on the plurality of bars with one another in response to a maximum identified cross-process position error not exceeding a predetermined threshold.

15. The printer of claim 14, the controller being further configured to modify either the identified first position for each printhead or the identified second position for each printhead with a dimensional change for the media that occurs as the media is transported from a first print bar to another print bar.

16. The printer of claim 14 wherein the controller is configured to operate the printheads to eject ink onto the media in a test pattern arrangement that is comprised of a plurality of arrangements of dashes ejected onto the media substrate, each arrangement of dashes having a predetermined number of rows and a predetermined number of columns, each dash in a row of dashes within an arrangement of dashes being separated by a first predetermined distance that corresponds to a distance in a cross-process direction between each inkjet ejector that ejected ink for a dash in a row of dashes and each dash in a column of dashes in the arrangement of dashes being separated by a second predetermined distance, each dash in a column of an arrangement of dashes being ejected by a single inkjet ejector in a printhead of the inkjet printer, and a plurality of unprinted areas interspersed between the plurality of arrangements of dashes.

17. The printer of claim 14, the controller being further configured to identify a series error distance for each group of printheads arranged in a column in the plurality of printheads and a stitch error distance for each pair of adjacent printheads in the printer in response to the maximum cross-process position error exceeding the predetermined threshold.

18. The printer of claim 17, the controller being further configured to identify the series error for each column of printheads by identifying an average position in the cross-process direction for the printheads arranged in a column and calculating a difference between each first cross-process position for each printhead arranged in the column of printheads and the identified average position for the printheads in the column of printheads.

19. The printer of claim 18, the controller being further configured to identify stitch errors for pairs of adjacent printheads in the plurality of printheads with reference to a reference stitch error.

20. The printer of claim 19, the controller being further configured to identify the reference stitch error with reference to a reference column of printheads, a reference print bar array, and a reference printhead that is in both the reference print bar array and the reference column of printheads.

21. The printer of claim 20, the controller being further configured to select a third cross-process position for each printhead in the plurality of printheads, the third cross-process position being selected to compensate for a dimensional change in the media, and to identify a second cross-process position error for each printhead that corresponds to a difference between the first cross-process position for a printhead and the identified third position for the printhead.

22. The printer of claim 21, the controller being configured to identify the second cross-process error for each printhead in the reference printhead array with reference to the first cross-process position, the reference stitch error, and the identified third position for the printhead for which the second cross-process error is being identified, and to identify the second cross-process position error for each printhead not in the reference print bar array with reference to the first cross-process position for the printhead, the identified stitch error for the printhead in the reference print bar array that is also in a column of printheads for the printhead, and the identified third position for the printhead.

23. The printer of claim 22, the controller being further configured to correlate all of the second cross-process position errors to a single second cross-process position error.

24. The printer of claim 23, the controller being configured to identify an average of all of the second cross-process position errors, and to modify each second cross-process position error by subtracting the average from each second cross-process position error in order to correlate all of the second cross-process position errors.

25. The printer of claim 23, the controller being configured to select one printhead from the plurality of printheads, and modify each second cross-process position error by subtracting the second cross-process position error from each second cross-process position error for each printhead in the plurality of printheads.

26. The printer of claim 22 wherein the controller operates each actuator in the plurality of actuators with reference to one of the identified second cross-process position errors.

* * * * *